United States Patent [19]

Klimpel et al.

[11] Patent Number: 4,826,588

[45] Date of Patent: May 2, 1989

[54] PYRITE DEPRESSANTS USEFUL IN THE SEPARATION OF PYRITE FROM COAL

[75] Inventors: Richard R. Klimpel; Robert D. Hansen; Michael J. Fazio, all of Midland, Mich.

[73] Assignee: The Dow Chemical Company, Midland, Mich.

[21] Appl. No.: 187,115

[22] Filed: Apr. 28, 1988

[51] Int. Cl.[4] ..... B03D 1/02

[52] U.S. Cl. ..... 209/167; 252/61; 44/625

[58] Field of Search ..... 209/166, 167; 252/61; 44/625

[56] References Cited

U.S. PATENT DOCUMENTS

| | | | |
|---|---|---|---|
| 1,329,493 | 2/1920 | Bacon | 209/166 |
| 2,112,362 | 3/1938 | Gillson | 209/166 |
| 3,006,471 | 10/1961 | Lutlinger | 209/166 |
| 3,796,308 | 3/1974 | McIlhinney et al. | 209/167 |
| 3,807,557 | 4/1974 | Miller | 209/166 |
| 3,908,912 | 9/1975 | Irons et al. | 209/164 |
| 3,919,080 | 11/1975 | Stauter | 209/167 |
| 3,938,966 | 2/1976 | Kindig et al. | 44/1 R |
| 4,141,691 | 2/1979 | Antonetti | 209/166 |
| 4,167,397 | 9/1979 | Grant | 44/1 R |
| 4,198,291 | 4/1980 | Yoo et al. | 209/172 |
| 4,211,642 | 7/1980 | Petrovich | 209/167 |
| 4,261,699 | 4/1981 | Sun et al. | 44/1 SR |
| 4,268,379 | 5/1981 | Paulos | 209/166 |
| 4,270,926 | 6/1981 | Burk, Jr. et al. | 209/166 |
| 4,272,250 | 6/1981 | Burk, Jr. et al. | 209/166 |
| 4,297,108 | 10/1981 | Horowitz et al. | 209/166 |
| 4,324,560 | 4/1982 | Fonseca | 44/1 SR |
| 4,388,181 | 6/1983 | Rainis et al. | 209/166 |
| 4,394,257 | 7/1983 | Wang | 209/166 |
| 4,448,584 | 5/1984 | Masologites et al. | 44/1 SR |
| 4,532,031 | 7/1985 | Wang | 209/166 |
| 4,536,372 | 8/1985 | Burgess et al. | 44/51 |
| 4,537,599 | 8/1985 | Greenwald, Sr. | 44/10 R |
| 4,640,789 | 2/1987 | Bresson | 209/166 |
| 4,676,890 | 6/1987 | Klimpel et al. | 209/166 |
| 4,684,459 | 8/1987 | Klimpel et al. | 209/166 |

FOREIGN PATENT DOCUMENTS

| | | | |
|---|---|---|---|
| 16914 | 10/1980 | European Pat. Off. | 209/166 |
| 2174019 | 10/1986 | United Kingdom | 209/167 |

OTHER PUBLICATIONS

Summary of "Technical Proposal on Coal Surface Control for Advanced Physical Fine Coal Cleaning Technologies," Dow Proposal No. 1881502, Jan. 5, 1988.

Baker et al., *U.S. Clearinghouse Fed. Sci. Tech. Inform.,* PB Rep. 1971, No. 200700.

Y. A. Attia, Fossil Fuels Utilization: Environmental Concerns, pp. 21–29 (American Chemical Society 1986).

Chernosky et al., *Transactions of AIME,* 252 11–14 (1972).

Woodburn et al., *Filtr. Sep.,* 1987, 24(2), 89–90, 92–96.

Perry et al., *Coal Sci. Technol.,* 1985, 9(Process. Util. High Sulfur Coals), 215–238.

*Primary Examiner*—Kenneth M. Schor
*Assistant Examiner*—Thomas M. Lithgow
*Attorney, Agent, or Firm*—Paula S. Ruhr

[57] ABSTRACT

The separation of coal from pyrite during a froth flotation process is enhanced by the use of an effective amount of a pyrite depressant. The depressant is a hydrophilic nitrogen-sulfur-containing compound.

15 Claims, No Drawings

PYRITE DEPRESSANTS USEFUL IN THE SEPARATION OF PYRITE FROM COAL

BACKGROUND OF THE INVENTION

This invention relates to the separation of sulfur-containing compounds from coal by froth flotation techniques.

Many coals contain relatively large amounts of sulfur ranging generally from less than one percent, to as high as about 6 percent. Inorganic sulfur, which is predominantly in the form of pyrite ($FeS_2$), generally accounts for about 40 to 80 percent of the sulfur in most coals. The inorganic sulfur is present in both macroscopic and microscopic forms. The macroscopic form is generally present as veins, lenses, nodules or beds while the microscopic form occurs as finely disseminated particles which may be as small as one or two microns in diameter. The balance of the sulfur present in the coal is organic sulfur. The organic sulfur is typically present as mercaptans and sulfides and is incorporated into the coal structure itself.

Air pollution resulting from the burning of sulfur-containing coals is becoming of increasing concern due to the acid rain problems experienced in various parts of the world. The sulfur dioxide emitted when sulfur-containing coals are burned is thought to be a major factor in the acid rain problem. Various approaches to limiting the amount of sulfur dioxide emitted when sulfur-containing coal is burned have been investigated. One approach is to remove the sulfur dioxide from flue gases resulting from burning sulfur-containing fuels such as the process described in U.S. Pat. No. 4,612,175. Other approaches are directed to removing the sulfur from the coal before it is burned. Since the organic sulfur is typically extremely difficult to remove from the coal, the major portion of efforts in this area have been focused on the removal of the inorganic sulfur from coal.

One approach to the removal of inorganic sulfur from coal is flotation. Flotation is a process of treating a mixture of finely divided raw coal suspended in a liquid. Flotation allows the separation of the desired solid, coal, from other undesired finely divided solids called gangue such as pyrite and ash that are also present in the liquid. A gas is introduced into the liquid or created in situ to provide a frothy mass. This frothy mass will contain certain of the solids and carry these to the top of the liquid with the froth and leave other solids suspended in the liquid. Flotation is based on the principle that introducing a gas into a liquid containing different solid particles causes the selective adherence of some gas to part of the suspended solids and not to others. The particles adhering to the gas are lighter than the other solids and thus are floated to the surface while other particles not adhering to the gas remain suspended in the liquid. The selective adherence of the gas to some of the solid particles, but not to others, is due to physical, chemical or surface differences in the solid particles.

Coal is normally hydrophobic in an aqueous mixture. That is, coal particles do not wet easily with water and therefore have some natural tendency to adhere to the gas bubbles. Various chemical additives are used in coal flotation to enhance this natural tendency of coal to float. Collectors, which are one type of these chemical additives, are commonly used to encourage the natural hydrophobicity of the coal. The collector increases the efficiency with which the gas bubbles attach to the coal.

In situations wherein the coal is oxidized or otherwise difficult to float, a promoter may be added in addition to the collector to promote its efficiency. Another important chemical component usually employed in coal flotation is a frother. Frothers help to control the rate and efficiency of the contact between bubbles and particles; the rate and efficiency of the adherence of the particle to the bubble; and, the rate and efficiency of the removal of the bubble and particle from the liquid.

In addition to the use of chemical additives, a necessary part of any successful coal flotation process is sufficient size reduction of the raw coal particles prior to actual flotation. The size reduction is necessary so that the majority of coal and the various gangue solids present exist as physically distinct particles (liberated particles) or as particles existing in a loose agglomeration. Only when the particles exist in this state are the chemical additives discussed above successful in separating the coal from gangue.

When the coal and the various gangue particles possess similar characteristics, it becomes difficult to separate them using simple flotation. When the differences in the characteristics of the solid particles are small or when the desirable and gangue solids both tend to float as is often the case with coal and pyrite in practice, it becomes necessary to use various methods to create or enhance the differences in the particles so that separation by flotation may be accomplished. Various techniques and processes exist to accomplish this.

One technique used to separate coal from inorganic sulfur-containing compounds in flotation processes focuses on the use of depressants to depress the flotation of either the coal or the inorganic sulfur-containing compound. A depressant is an agent that, when added to the flotation system, exerts a specific action on the material to be depressed thereby preventing it from floating. Various theories have been put forth to explain this phenomenon. Some of these include: that the depressants react chemically with the mineral surface to produce insoluble protective films of a wettable nature which fail to react with collectors: that the depressants, by various physical-chemical mechanisms, such as surface adsorption, mass-action effects, complex formation or the like, prevent the formation of the collector film; that the depressants act as solvents for an activating film naturally associated with the mineral; and that the depressants act as solvents for the collecting film. These theories appear closely related and the correct theory may eventually be found to involve elements of most or all of these and more.

U.S. Pat. No. 3,919,080 teaches that the flotation of inorganic sulfur as pyritic sulfur in the aqueous flotation of coal particles is depressed by the addition of sulfite to the flotation pulp. U.S. Pat. No. 3,807,557 discloses that pyrite is removed from coal in a two-stage flotation process. The conventional first flotation is followed by a second stage which uses an organic colloid as a depressant for the coal. The use of polyhydroxy alkyl xanthate depressants to depress the flotation of pyrite in coal flotation is taught in U.S. Pat. No. 4,211,642. Great Britain patent application No. 2,174,019A teaches that a compound which has one group capable of adhering to the surface of a hydrophilic mineral which group is bonded to a second group which is polar in nature and has hydrophilic properties is useful in coal flotation to depress the flotation of pyrite.

Although many approaches have been suggested for the separation of inorganic sulfur from coal, the methods suggested are not without problems. Some of these problems include the removal of insufficient quantities of inorganic sulfur from the coal and lower overall coal recoveries. Thus, what is needed is a process for the separation of coal from sulfur that is inexpensive and simple to implement and to use and that significantly reduces the amount of inorganic sulfur remaining with the coal while not adversely affecting coal recovery.

SUMMARY OF THE INVENTION

This invention is such a process for the depression of the flotation of inorganic sulfur-containing compounds in a process for the flotation of coal. This process comprises subjecting coal, which contains inorganic sulfur-containing compounds: is in the form of an aqueous slurry; and has undergone sufficient size reduction so that the majority of the coal particles and particles of the inorganic sulfur-containing compounds exist as physically distinct particles or as particles in a loose agglomeration, to a froth flotation process in the presence of an effective amount of a depressant for inorganic sulfur-containing compounds under conditions such that the flotation of the inorganic sulfur-containing compounds is depressed, wherein the depressant comprises a compound corresponding to the formula:

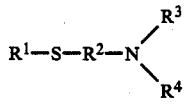

(I)

wherein $R^1$ is

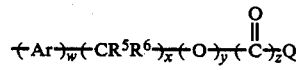

(II)

wherein Ar is a divalent aromatic hydrocarbon radical or a subsituted divalent aromatic hydrocarbon radical; w is from about zero to about 1; x is from about zero to about 12; y is from about zero to about 6; z is from about zero to about 1; each moiety can occur in random sequence, e.g., the case wherein x is 6 and y is 3 may be represented as the following $$-(CR^5R^6)_2O-(CR^5R^6)_2O-(CR^5R^6)_2O-;$$

$R^5$ and $R^6$ are individually in each occurrence hydrogen, alkyl, hydroxy or alkoxy: and Q is hydrogen or hydroxy; $R_2$ is

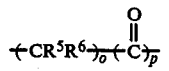

(III)

wherein the sum (n+o+p) is four or less; n is at least about 1 and no greater than about 4; o and p are individually in each occurrence zero or 1; $R^5$ and $R^6$ are as defined above: and each moiety can occur in random sequence: and $R^3$ and $R^4$ are

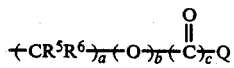

(IV)

wherein a is from about zero to about 2; b is from about zero to about 1; and c is from about zero to about 1; each moiety can occur in random sequence as described above; and $R^5$, $R^6$ and Q are as defined above.

Surprisingly, the method of the present invention selectively depresses the flotation of inorganic sulfur-containing compounds while not adversely affecting coal recovery.

DETAILED DESCRIPTION OF ILLUSTRATIVE EMBODIMENTS

Although not specifically set forth in the formulas above, in aqueous mediums of suitable pH, the depressant used in the method of this invention may exist in the form of a salt.

In the formula for $R^1$ set forth above, Ar preferably is phenyl, benzyl, biphenyl or naphthyl or substituted phenyl, substituted benzyl, substituted biphenyl or substituted naphthyl. Examples of suitable substituents include hydroxy, amino, phosphonyl, ether, carbonyl, carboxy and sulfo. Preferred substituents include carboxy and sulfo.

In one preferred embodiment of this invention, $R^1$ is represented by Formula II wherein w, y and z are each zero: x is at least about 1 and no greater than about 5; $R^5$ and $R^6$ are each hydrogen or methyl and Q is hydrogen. It is more preferred in this embodiment that x is at least about 1 and no greater than about 2 and that $R^5$ and $R^6$ are each hydrogen. In a second preferred embodiment of $R^1$, x is at least one and no greater than about 2, z is about 1 and w and y are each zero and Q is hydroxy. In a third preferred embodiment, w and z are each zero: x is at least about 2 and no greater than about 6; y is at least about 1 and no greater than about 3; $R^5$ and $R^6$ are independently hydrogen, methyl or ethyl; and Q is hydrogen.

In a preferred embodiment of this invention, $R^2$ is represented by Formula III wherein o and p are each zero: n is at least about 2 and no greater than about 3; and $R^5$ and $R^6$ are each hydrogen. It is most preferred that n is 2.

In a preferred embodiment of this invention, $R^3$ and $R^4$ are each independently represented by Formula IV wherein a is from zero to about 2, b is zero and c is zero or 1. It is most preferred that a, b and c are each zero and than Q is hydrogen.

The depressants useful in the practice of this invention thus include, as non-limiting examples, $CH_3S(CH_2)_2NH_2$, $CH_3(CH_2)_3S(CH_2)_2NH_2$, $HOCH_2CH_2S(CH_2)_2NH_2$, and $HOOCCH_2S(CH_2)_2NH_2$. These compounds are either available commercially or can be prepared by methods known in the art. For example, The depressants useful in this invention may be prepared by the reaction of a mercaptan and 2-oxazoline in the presence of a catalytic amount of a transition metal salt as taught in U.S. Pat. No. 4,086,273. They may also be prepared by the reaction of a mercaptan and an alkanol amine sulfate as taught in U.S. Pat. No. 2,689,867 or the reaction of a primary amine and a mercapto halide at elevated temperature and pressure as taught in U.S. Pat. No. 2,769,839.

The pyrite depressant represented as formula (I) may be used without further modification or may be incorporated into a polymer backbone. Examples of polymers suitable for this purpose include the water-dispersible polymers or salts thereof of anionic monomers such as $\alpha,\beta$-ethylenically unsaturated acids or esters including, as examples, acrylic, methacrylic, fumaric, maleic, crotonic, itaconic, or citraconic acids and partial esters of $\alpha,\beta$-ethylenically unsaturated polycarboxylic acids such as methyl acid maleate and ethyl acid fumarate. Additional examples of polymers suitable for this purpose include polyepoxides, formed, for example, by the homopolymerization or copolymerization of glycidyl methacrylate. Other polymers which may be used include polyepichlorohydrins and polyethylenimines.

The polymers useful in the practice of this invention may be of any molecular weight so long as they have the effect of depressing the flotation of the inorganic sulfur, have no significant impact on the flotation of coal and possess essentially no flocculating properties. It is preferred that the average molecular weight be less than about 40,000. It is more preferred that the average molecular weight be less than about 25,000 and it is most preferred that it be less than about 15,000. It is preferred that the average molecular weight be greater than about 500 and more preferred that it be greater than about 2000. It is most preferred that the average molecular weight of the polymeric acidor salt thereof be greater than about 4000.

The pyrite depressant represented by formula (I) may be incorporated into a polymer backbone by methods known in the art. For example, they may be prepared by polyethylenimine acylation as taught in U.S. Pat. No. 2,382,185; by the reaction of a polyepichlorohydrin and an amine as taught in U.S. Pat. No. 3,320,317; or by the amidation or transesterification of an acrylate polymer.

Any amount of depressant which will depress the flotation of the inorganic sulfur may be used in the practice of this invention. Generally, the amount of depressant needed will vary depending on the conditions of the flotation process and the degree of hydrolysis of the depressant. Other factors which will affect the amount of depressant which will be useful in the practice of this invention include the type of coal subjected to flotation and the amount of inorganic sulfur-containing compounds present with the coal. It is preferred that at least about 0.01 kilogram of depressant is used per metric ton of coal to be floated. It is more preferred that at least 0.025 kilogram of depressant is used per metric ton of coal to be floated. It is preferred that no more than about 1 kilogram of depressant is used per metric ton of coal to be floated and more preferred that no more than about 0.5 kilogram of depressant be used per metric ton of coal to be floated.

The depressants useful in the practice of this invention are effective when used in conjunction with a wide variety of collectors and frothers useful in coal flotation. When the coal to be floated is oxidized or otherwise difficult to float, promoters may also be used to increase the efficiency of the collectors. Examples of collectors useful in the froth flotation of coal include fuel oils, kerosene, naphtha and other hydrocarbons. Materials such as amines, fatty acid amine condensates, and surfactants containing multiple ethylene oxide or propylene oxide moieties are examples of promoters. Examples of frothers useful in coal flotation include pine oils, eucalyptus oils, alcohols containing 5 to 12 carbons, cresols, $C_1$ to $C_4$ alkyl ethers of polypropylene glycols, dihyroxylates of polypropylene glycols and glycols. The selection of appropriate collectors and frothers will be made based on the circumstances of the particular flotation process. For discussions of frothers and collectors useful in coal flotation, see Klimpel et al., *Fine Coal Processing*, S. K. Mishra and R. R. Klimpel, eds., Noyes Publishing, Park Ridge, N.J., pp. 78–108 (1987) and Laskowski et al., *Reagents in the Mineral Industry—Rome Meeting*, Inst. of Min. Met., M. J. Jones and R. Oblatt, eds., pp. 145–154 (1984), hereby incorporated by reference.

The depressant may be added at any stage of the separation process so long as it is added prior to the flotation step. It is preferred to add the depressant before or with the addition of the collector, if any collector is to be added. It is more preferred to add the depressant before the addition of the collector, if any.

The coal flotation process of this invention may be performed at any pH at which the depressants of this invention will selectively depress the flotation of inorganic sulfur-containing compounds. It is preferred to perform the flotation at the natural pH of the coal feed which is typically at least about 4.0 and no greater than about 8.5. However, in some situations, it is preferable to adjust the pH to optimize the effect of the depressants of this invention. For example, if the coal being subjected to flotation is particularly high in sulfur-containing compounds, the cost of adjusting pH may be offset by the increase in the amount by which the flotation of inorganic sulfur-containing compounds is depressed. In those instances where it is desirable to optimize the amount by which the flotation of inorganic sulfur-containing compounds is depressed, it is preferred to perform the coal flotation process of this invention at a pH of at least about 5.5 and no greater than about 8.5.

The process of this invention may be practiced using various sized particles of raw coal as long as sufficient size reduction occurs prior to the flotation process. Sufficient size reduction is obtained when the majority of coal and gangue, such as pyrite, particles exist as physically distinct particles or as particles existing in a loose agglomeration. Unless the particles exist in this physically separate form, they cannot be separated by flotation. It is generally necessary to grind and/or mill the raw coal to attain sufficient size reduction of the particles prior to the actual flotation. Coal may be ground dry, semi-dry or in slurry form. When coal is ground in slurry form, the slurry generally contains at least about 50 weight percent solids. Various raw coals require different degrees of grinding to achieve sufficient size reduction depending on the geological history of the coal formation. It is generally preferable that raw coal particles be sized to at least about 10 percent of the particles smaller than 75 micrometers to about 90 percent smaller than 75 micrometers for flotation.

The ground coal is slurried with water prior to being subjected to the flotation process. It is preferred that the solids content of the aqueous coal slurry is at least about 2 weight percent and no greater than about 30 weight percent.

The depressants useful in the practice of this invention depress the flotation of inorganic sulfur-containing compounds. By inorganic sulfur-containing compounds is meant inorganic compounds normally associated with coal which are primarily metal-sulfur compounds, preferably iron-sulfur compounds. Examples of iron-containing compounds include pyrite ($FeS_2$), marcasite and pyrrhotite. It is preferred that the inorganic sulfur-containing compound separated from the desired coal be pyrite.

The degree by which the flotation of inorganic sulfur-containing compounds is depressed by the practice of this invention is any which will allow an improved separation of the inorganic sulfur-containing compounds from the coal. Two factors are important in observing this improvement. The primary factor is that the amount of inorganic sulfur-containing compounds floated with the coal is minimized. The second factor is that the amount of clean coal recovered is optimized. The relative importance of these two factors may vary in different situations. It will be recognized by those skilled in the art that in some situations, it will be desirable to minimize the amount of sulfur-containing compounds recovered even if the recovery of clean coal is also affected. An example of such a situation is when coal contains a level of sulfur-containing compounds so high that the coal is effectively not usable. In such a situation, a significant reduction in the amount of inorganic sulfur-containing compounds is desirable even when accompanied by a reduction in the overall amount of clean coal recovered.

It is preferred that the flotation of inorganic sulfur-containing compounds is depressed by at least about five percent by the use of the depressants of this invention. It is more preferred that the flotation of the inorganic sulfur-containing compounds is depressed by at least about ten percent.

The following examples are provided by way of illustration and are not given to limit the invention in any way. Unless stated otherwise, all parts and percentages are given by weight.

EXAMPLES C-1 AND 1-2 - DEPRESSION OF PYRITE FLOTATION IN LOW SULFUR COAL

Coal from the Lower Freeport Seam is crushed and a size fraction between 0.75 inch and 10 mesh (U.S. Standard) is split successively through a riffle splitter and a carousel packaging device and packaged into about 200-gram samples. The samples, which contain about 5 weight percent pyrite or about 2.7 weight percent sulfur, are stored in a freezer prior to use to retard oxidation.

Prior to flotation, a 200-gram sample of coal prepared as described above is placed in a rod mill with a diameter of 8 inches and a length of 9.5 inches. Eight 1-inch diameter stainless steel rods are also placed in the rod mill. The flotation depressant, when used, and 500 ml of deionized water are added at this time. The coal is milled for 300 revolutions at 60 revolutions per minute (RPM) and then the slurry is transferred to a 3-liter cell of an Agitair flotation machine. Deionized water is added to the cell to bring the volume to the mark and the pH is measured. Any adjustments to pH are made at this time by the addition of NaOH solution. A purified kerosene collector is added in an amount equivalent to 1.0 kilogram of collector per ton of raw coal feed and the slurry is conditioned for one minute with agitation. A frother, the reaction product of glycerol with propylene oxide with a molecular weight of about 450, is added next in an amount equivalent to 0.1 kilogram per ton of raw coal feed. The slurry is again conditioned for one minute and then air is introduced into the flotation cell at a rate of 9 liters per minute. A motorized paddle rotating at 10 RPM is turned on and sweeps the coal laden froth from the lip of the float cell into a collector tray. Froth is collected in two portions, the first for 30 seconds after the start of flotation and the second for the next 3.5 minutes.

The froth concentrates and the non-floated material, the tailings, are oven dried overnight at 110° C. They are then weighed and samples are taken for analysis. The ash content of each froth concentrate and tailing sample is determined by ignition of a one-gram portion at 750° C. in a muffle furnace. The clean coal recovery is then calculated by the following formula:

$$\text{Percent of Clean Coal Recovery} = [A/(A+B)] \times 100$$

where A is the amount of recovered coal in the froth concentrate minus the amount of ash in the froth concentrate and B is the amount of coal in the tailings minus the amount of ash in the tailings. Thus, the percent of clean coal recovered is the percentage of the coal that is originally present that is recovered after the flotation process.

The inorganic sulfur content of the coal sample is determined by analyzing a weighed portion of each sample. The sample is analyzed for Fe and the percentage of Fe content is related to sulfur content since the sulfur is present in the form of pyrite ($FeS_2$). The weighed portion of the sample is oxidized by a nitric acid solution and then is digested in a sulfuric acid solution. The solution is then diluted to a standard volume and the iron content is determined with a DC Plasma Spectrometer. The percent of iron pyrite remaining with the coal which is equivalent to the percent of sulfur remaining is then calculated as the pyrite content of the froth concentrate divided by the pyrite content of the concentrate plus the pyrite content of the non-floated tailings. This amount is multiplied by 100 to obtain the percentage. Thus, the percent of pyrite remaining is the percentage of pyrite originally present in the coal which remains with the coal after the flotation process.

The results obtained are shown in Table I below.

TABLE I

| Example | Depressant (0.025 kg/ton) | % Clean Coal Recovery[1] | % Reduction in Clean Coal Recovery[2] | % Pyrite Remaining[3] | % Reduction in Pyrite Remaining[4] |
|---|---|---|---|---|---|
| C-1 | none | 82.4 | — | 32.8 | — |
| 1 | $C_4H_9S(CH_2)_2NH_2$ | 81.3 | 1.3 | 30.8 | 6.1 |
| 2 | $HO_2CCH_2S(CH_2)NH_2$ | 80.9 | 1.8 | 27.9 | 14.9 |

[1]Percentage of coal that is originally present that is recovered after treatment
[2]Percentage by which clean coal recovery is reduced by the use of the depressant of this invention
[3]Percentage of pyrite originally present that remains with the recovered clean coal
[4]Percentage by which pyrite remaining is reduced by the use of the depressant of this invention The data in Table I show that improvement in the separation of coal from inorganic sulfur is observed when the pyrite depressant of this invention is used in an otherwise conventional flotation process for the flotation of coal having a relatively low sulfur content.

EXAMPLES 3-8 AND C-2 - DEPRESSION OF PYRITE FLOTATION IN HIGH SULFUR COAL

Coal from the Lower Freeport Seam is crushed and a size fraction finer than 10 mesh (U.S. Standard) is split successively through a riffle splitter and a carousel packaging device and packaged into about 200-gram samples. The samples, which contain about 7 weight percent pyrite or about 3.8 weight percent sulfur, are stored in a freezer prior to use to retard oxidation.

Prior to flotation, a 200-gram sample of coal prepared as described above is placed in a rod mill with a diameter of 8 inches and a length of 9.5 inches. Eight 1-inch diameter stainless steel rods are also placed in the rod mill. The flotation depressant, if any, and 500 ml of deionized water are added at this time. The coal is milled for 60 revolutions at 60 revolutions per minute (RPM) and then the slurry is transferred to a 3-liter cell of an Agitair flotation machine. Deionized water is added to the cell to bring the volume to the mark and the pH is measured. Any adjustments to pH are made at this time by the addition of NaOH solution A purified kerosene collector is added in an amount equivalent to 1.0 kilogram of collector per ton of raw coal feed and the slurry is conditioned for one minute with agitation. A frother, a methyl ether of a polypropylene oxide having a molecular weight of about 400, is added next in an amount equivalent to 0.1 kilogram per ton of raw coal feed. The slurry is again conditioned for one minute and then air is introduced into the flotation cell at a rate of 9 liters per minute. A motorized paddle rotating at 10 RPM is turned on and sweeps the coal laden froth from the lipof the float cell into a collector tray. Froth is collected in two portions, the first for 30 seconds after the start of flotation and the second for the next 3.5 minutes.

The samples of froth concentrate and flotation tailings are collected, dried, sampled and analyzed as described in the previous examples. The results obtained are given in Table II below.

TABLE II

| Example | Depressant (0.025 kg/ton) | % Clean Coal Recovery[1] | % Reduction in Clean Coal Recovery[2] | % Pyrite Remaining[3] | % Reduction in Pyrite Remaining[4] |
|---|---|---|---|---|---|
| C-2 | none | 81.2 | — | 45.6 | — |
| 3 | $CH_3S(CH_2)_2NH_2$ | 78.3 | 3.6 | 40.9 | 10.3 |
| 4 | $C_4H_9S(CH_2)_2NH_2$ | 79.9 | 1.6 | 38.9 | 14.7 |
| 5 | $HO(CH_2)_2S(CH_2)_2NH_2$ | 78.9 | 2.8 | 38.9 | 14.7 |
| 6 | $C_7H_{15}S(CH_2)_2NH_2.HCl$ | 78.5 | 3.3 | 42.2 | 7.5 |
| 7 | $C_{10}H_{21}S(CH_2)_2NH_2.HCl$ | 80.3 | 1.1 | 44.0 | 3.5 |
| 8 | $HO_2CCH_2S(CH_2)_2NH_2$ | 77.8 | 4.2 | 36.2 | 20.6 |

[1]Percentage of coal that is originally present that is recovered after treatment
[2]Percentage by which clean coal recovery is reduced by the use of the depressant of this invention
[3]Percentage of pyrite originally present that remains with the recovered clean coal
[4]Percentage by which pyrite remaining is reduced by the use of the depressant of this invention A comparison of Comparative Example 2 and Examples 3–8 demonstrates that the use of the depressants listed lowers the amount of pyrite floated with only minor reductions in the amount of coal floated. This demonstrates the effectiveness of the depressants of this invention when a relatively high sulfur coal is treated. An examination of Examples 2, 4, 5 and 8, which represent preferred embodiments of the invention, as compared to Examples 6 and 7 demonstrates that smaller alkyl groups and/or the presence of a polar group in the depressants of this invention results in a more effective separation of pyrite and coal.

EXAMPLES 9–12 AND COMPARATIVE EXAMPLES C-3-7 - EFFECT OF PARTICLE LIBERATION

The procedure outlined for Examples 2–8 is repeated using a different fraction of Lower Freeport Seam coal sized smaller than 10 mesh. It should be noted that the minus 10 fraction used in these examples was prepared at a different time than the samples used in Examples 3–8 and, as is obvious from the data presented in Table III below, possesses a different degree of liberation. In these examples, the number of revolutions the coal is rod milled is varied. The results obtained are shown in Table III below.

TABLE III

| Example | Depressant (0.025 kg/ton) | Grind[1] (rev) | % Clean Coal Recovery[2] | % Reduction in Clean Coal Recovery[3] | % Pyrite Remaining[4] | % Reduction in Pyrite Remaining[5] |
|---|---|---|---|---|---|---|
| C-3 | none | 60 | 76.4 | — | 38.0 | — |
| C-4 | $HO_2CCH_2S(CH_2)_2NH_2$ | 60 | 77.2 | — | 39.6 | — |
| C-5 | $CH_2S(CH_2)_2NH_2$ | 60 | 78.5 | — | 40.3 | — |
| C-6 | none | 120 | 74.1 | — | 33.8 | — |
| 9 | $HO_2CCH_2S(CH_2)_2NH_2$ | 120 | 73.0 | 1.5 | 32.0 | 5.3 |
| 10 | $CH_3S(CH_2)_2NH_2$ | 120 | 74.0 | 0.1 | 33.5 | 0.8 |
| C-7 | none | 180 | 63.6 | — | 25.3 | — |
| 11 | $HO_2CCH_2S(CH_2)_2NH_2$ | 180 | 63.6 | 0 | 23.9 | 5.5 |
| 12 | $CH_3S(CH_2)_2NH_2$ | 180 | 60.9 | 4.2 | 20.3 | 19.8 |

[1]Number of revolutions raw coal is milled in the rod mill prior to flotation
[2]Percentage of clean coal that is originally present that is recovered after treatment
[3]Percentage of which clean coal recovery is reduced by the use of the depressant of this invention
[4]Percentage of pyrite originally present that remains with the recovered clean coal
[5]Percentage by which pyrite remaining is reduced by the use of the depressant of this invention The criticality of insufficient liberation of the particles of coal and pyrite is demonstrated in Comparative Examples C-3 through C-5. In each case, the depressants of this invention have no depressing effect on the flotation of pyrite due to lack of sufficient size reduction and particle liberation. The effect of size reduction is shown in Comparative Examples C-3, C-6 and C-7 where it can be observed that increasing the number of grind revolutions from 60 to 120 to 180 results in corresponding decreases in both the clean coal recovery and the pyrite remaining with the clean coal. Examples 9–12 demonstrate that the depressants of this invention are effective when sufficient size reduction of the raw coal is obtained. The greater liberation of coal particles and pyrite particles obtained when the coal is rod milled 180 revolutions as compared to 120 revolutions permits more effective separation of coal from pyrite.

What is claimed is:

1. A process for the depression of the flotation of inorganic sulfur-containing compounds in coal flotation which comprises subjecting raw coal, which contains inorganic sulfur-containing compounds and has undergone sufficient size reduction so that a majority of the coal particles and particles of the inorganic sulfur-containing compounds exist as physically distinct particles or as particles in a loose agglomeration and is in the form of an aqueous slurry, to a froth flotation process in the presence of a depressant for the flotation of inorganic sulfur-containing compounds under conditions such that the flotation of the inorganic sulfur is depressed, wherein the depressant comprises a compound corresponding to the formula:

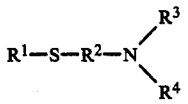

(I)

wherein $R^1$ is

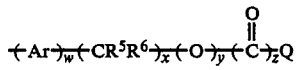

(II)

wherein Ar is a divalent aromatic hydrocarbon radical or a substituted divalent aromatic hydrocarbon radical; w is from zero to 1; x is from zero to 12; y is from zero to 6; z is from zero to 1 and each moiety can occur in random sequence; $R^5$ and $R^6$ are individually in each occurence hydrogen, alkyl, hydroxy or alkoxy; and Q is hydrogen or hydroxy; $R^2$ is $$-CR^5R^6)_n(O)_o \qquad \text{(III)}$$

wherein the sum (n+o) is four or less; n is at least 1 and no greater than 4; o is zero or 1; $R^5$ and $R^6$ are as defined above; and each moiety can occur in random seduence; and $R^3$ and $R^4$ are independently in each occurrence

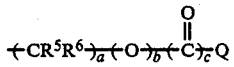

(IV)

wherein a is from zero to 2; b and c are each independently from zero to 1; each moiety can occur in random sequence add $R^5$, $R^6$ and Q are as defined above.

2. The process of claim 1 wherein the coal is size reduced to be at least about 10 percent of the coal particles smaller than about 75 micrometers.

3. The process of claim 1 wherein o is zero, n is at least 2 and no greater than 3 and $R^5$ and $R^6$ are each hydrogen.

4. The process of claim 3 wherein n is two.

5. The process of claim 3 wherein w, y and z are zero; x is at least 1 and no greater than 5 and Q is hydrogen.

6. The process of claim 5 wherein x is at least 1 and no greater than 2.

7. The process of claim 3 wherein w and y are each zero, x is at least 1 and no greater than 2 and Q is hydroxy.

8. The process of claim 3 wherein w and z are each zero; x is at least 2 and no greater than 6; y is at least 1 and no greater than 3; $R^5$ and $R^6$ are independently in each occurrence hydrogen, methyl or ethyl and Q is hydrogen.

9. The process of claim 3 wherein a, b and c are each zero and Q is hydrogen.

10. The process of claim 3 wherein the depressant is used at a level of at least about 0.01 kilogram of depressant per metric ton of raw coal and no greater than about 1 kilogram of depressant per metric ton of raw coal.

11. The process of claim 10 wherein the depressant is used at a level of at least about 0.025 kilogram of depressant per metric ton of raw coal and no greater than about 0.5 kilogram of depressant per metric ton of raw coal.

12. The process of claim 1 wherein the coal flotation process is performed at the natural pH of the raw coal.

13. The process of claim 1 wherein the coal flotation process is performed at a pH of about 8.0.

14. The process of claim 1 wherein the sulfur-containing compound is pyrite.

15. The process of claim 2 wherein the coal is size reduced to be at least about 90 percent of the coal particles smaller than about 75 micrometers.

* * * * *

UNITED STATES PATENT AND TRADEMARK OFFICE

CERTIFICATE OF CORRECTION

PATENT NO. : 4,826,588

DATED : May 2, 1989

INVENTOR(S) : Richard R. Klimpel; Robert D. Hansen; Michael J. Fazio

It is certified that error appears in the above-identified patent and that said Letters Patent is hereby corrected as shown below:

Col. 3, line 56, the formula should read: $-(CR^5R^6)_n-(O)_o-\overset{O}{\overset{\|}{(C)}}_p-$ .

Col. 5, line 22, "acidor" should read -- acid or --.

Col. 9, line 16, a period should be inserted after "solution";

line 44, "lipof" should read -- lip of --.

Col. 11, line 45 (in Claim 1), the formula should read:

$$-(CR^5R^6)_n-(O)_o- \quad ;$$

line 49 (in Claim 1), "seduence" should read -- sequence --.

Col. 12, line 9 (in Claim 1), "add" should read -- and --.

Signed and Sealed this

Seventh Day of August, 1990

*Attest:*

HARRY F. MANBECK, JR.

*Attesting Officer*

*Commissioner of Patents and Trademarks*